US008810339B2

(12) United States Patent
Bernhardt et al.

(10) Patent No.: US 8,810,339 B2
(45) Date of Patent: Aug. 19, 2014

(54) RADIO FREQUENCY FILTER STABILIZATION

(75) Inventors: Timothy Bernhardt, Meriden, CT (US); Yin-Shing Chong, Middletown, CT (US); Yunchi Zhang, Wallingford, CT (US)

(73) Assignee: Alcatel Lucent, Boulogne-Billancourt (FR)

( * ) Notice: Subject to any disclaimer, the term of this patent is extended or adjusted under 35 U.S.C. 154(b) by 507 days.

(21) Appl. No.: 13/074,420

(22) Filed: Mar. 29, 2011

(65) Prior Publication Data

US 2012/0249267 A1 Oct. 4, 2012

(51) Int. Cl.
*H01P 1/205* (2006.01)
*H01P 1/202* (2006.01)

(52) U.S. Cl.
CPC ..... *H01P 1/2053* (2013.01); *H01P 1/202* (2013.01)
USPC ..... 333/206

(58) Field of Classification Search
CPC ..... H01P 1/201; H01P 1/202; H01P 1/2053; H01P 3/06
USPC ..... 333/135, 202, 206, 208–209, 219, 227, 333/229, 234, 239, 248
See application file for complete search history.

(56) References Cited

U.S. PATENT DOCUMENTS

| | | | | | |
|---|---|---|---|---|---|
| 3,621,484 | A * | 11/1971 | Shult | ..... | 333/202 |
| 4,567,454 | A * | 1/1986 | Saito | ..... | 333/206 |
| 4,914,722 | A * | 4/1990 | Holden et al. | ..... | 310/345 |
| 6,359,533 | B1 * | 3/2002 | Merlock et al. | ..... | 333/203 |
| 7,080,941 | B1 * | 7/2006 | Benjamin et al. | ..... | 374/179 |
| 7,625,247 | B1 * | 12/2009 | Mahoney et al. | ..... | 439/700 |

* cited by examiner

*Primary Examiner* — Benny Lee
*Assistant Examiner* — Rakesh Patel
(74) *Attorney, Agent, or Firm* — Kramer & Amado, P.C.

(57) ABSTRACT

An assembly and method relates to stabilizing a radio frequency (RF) filter with respect to a housing. The assembly can include a filter component; a housing having a groove to receive the filter component; a cover mounted to the housing to cover the groove; and an elastomeric element disposed between the cover and the filter. The elastomeric element may be one or more tubular pieces.

18 Claims, 7 Drawing Sheets

RADIO FREQUENCY FILTER STABILIZATION

TECHNICAL FIELD

The invention pertains to transmission of radio frequency signals and to filters used in transmission of radio frequency signals.

BACKGROUND

In-line filters are well known for use in radio frequency transmission lines. Examples of radio frequency filters include low pass filters. Further examples of low pass filters include generally cylindrical conductive structures, which may have changing outer diameters, and which may be surrounded by a dielectric material. Such filters have been known to be supported by a housing block having a channel into which the filter is placed, with a flat cover mounted over the top of the channel and the filter.

SUMMARY

A brief summary of various exemplary embodiments is presented in this section. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

Various exemplary embodiments relate to a radio frequency (RF) filter assembly, comprising: a filter component; a housing having a groove to receive the filter component; a cover mounted to the housing to cover the groove; and an elastomeric element disposed between the cover and the filter.

The elastomeric member can include two elastomeric members each in the shape of a rod, and may be made of silicone. The groove can define a semi-circular u-shaped surface and two side wall surfaces, each being on one side of the u-shaped surface. The tubular elastomeric member can be in contact with an outer surface of the filter, an inner surface of the channel, and an inner surface of the plate. The elastomeric member may have two parallel rod portions, connected to each other by a plurality of cross bar portions. The assembly may also have an extension block disposed in between the elastomeric member and the filter, having a lower surface having a concave curved portion.

Other exemplary embodiments relate to a method of stabilizing a radio frequency (RF) filter assembly, comprising: providing a filter component, a housing having a groove to receive the filter component, and a cover mounted to the housing to cover the groove; and compressing an elastomeric element disposed between the cover and the filter.

Other exemplary embodiments relate to a radio frequency (RF) filter assembly, comprising: a filter component; a housing having a groove to receive the filter component; a cover mounted to the housing to cover the groove; and stabilizing means, such as an elastomeric member, disposed between the cover and the filter.

BRIEF DESCRIPTION OF THE DRAWINGS

In order to better understand various exemplary embodiments, reference is made to the accompanying drawings, wherein.

DETAILED DESCRIPTION

Figure 1:
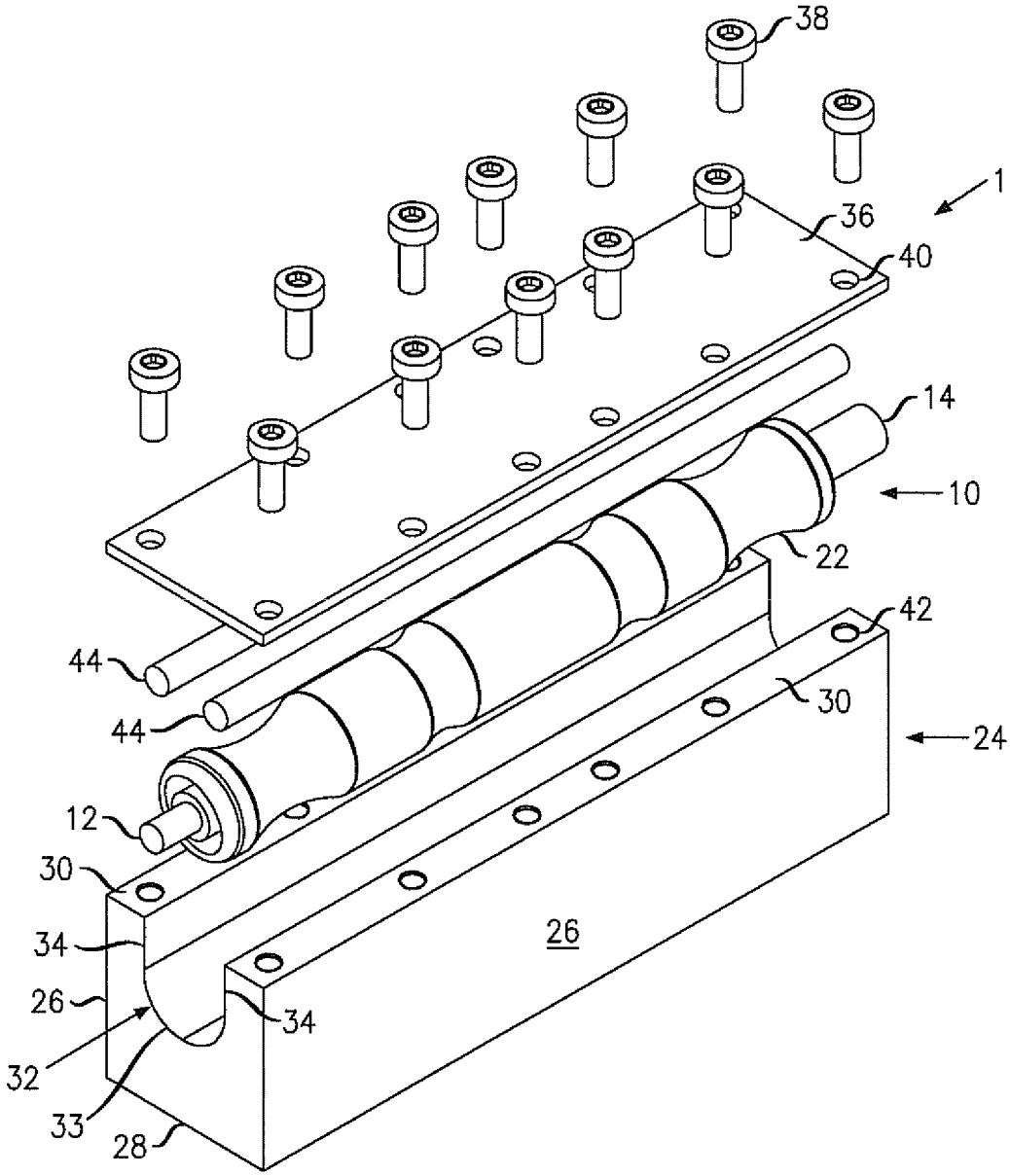
FIG. 1 is an exploded perspective view of a filter and housing assembly.

Various embodiments will now be described with reference to the drawing figures, including reference numerals relating to the various parts.

FIG. 1 is an exploded view depicting a first embodiment 1. A radio frequency (RF) filter 10 is provided. In this example, the RF filter 10 is a low pass filter having a first transmission line connector 12 at one end and a second transmission line connector 14 at the other end. As will be explained in further detail below, (with reference to FIGS. 4 and 5), the filter 10 is a low pass filter that has a main filter component 16 that has changing outer diameters. In this example, the main filter component 16 includes large diameter portions 18, which may be of varying lengths, and small diameter portions 20, which also may be of varying lengths as desired according to the low pass filter design. The filter 10 may be made of any suitable transmissive material, such as by way of example, brass or copper. Although a low pass filter is illustrated, various embodiments can be used with other types of filters or similarly shaped RF components.

The main filter component 16 is surrounded by a dielectric material 22. In the illustrated example, the dielectric material may be any suitable material such as, for example, a melt-processable fluoropolymer such as a heat shrink applied FEP (fluorinated ethylene propylene) material, in some cases with the dielectric outer material having been applied around the main filter component 16 using a heat gun. Alternatively, other dielectric surrounding materials may be used, and may be implemented or applied in different methods.

Returning to FIG. 1, the filter 10 may be supported by a main housing 24. The housing 24 can be constructed of any suitably rigid material, and in the illustrated example may be made of a metal such as aluminum, which may be unplated or may be plated with either copper or silver.

The housing 24 has sides 26 and a bottom surface 28, but may be any external shape and can be surrounded by and be a part of a cavity filter. The housing 24 also has two flat top mounting surfaces 30 which will be described in more detail below. The housing 24 further includes a channel 32 (also referred to herein as a groove) which is configured to receive and support the filter 10. In the illustrated example, the channel 32 has a lower surface 33 which is a semi-circle when viewed as an end view, and has two flat side surfaces 34. The radius of the semi-circular lower surface 33 may be selected to be dimensionally close to the largest outer radius of the filter 10. This can provide an advantage in some examples by which the largest outer surface of the filter 10 rests with the desired closeness to the housing 24, around approximately 180° of the 360° circumference of the filter 10. In other embodiments, the lower portion of the channel 32 may be square, in which case only three substantially tangential contact points with the filter 10 are provided between the filter 10 and the housing 24.

The assembly of FIG. 1 also includes a cover 36 which may be mounted to the top surfaces 30 of the housing 24 by any suitable attachment arrangement such as, for example, the provision of a plurality of screw-type fasteners 38. Screw-type fasteners 38 in an example may pass through mounting holes 40 in the cover 36 and into mounting holes 42 in the housing 24. The cover 36 may be made of any suitable material, for example, aluminum. The fasteners 38 may be any suitable fasteners, such as, for example, stainless steel screws.

FIG. 1 also illustrates that the filter arrangement includes two elastomeric elements 44. The elastomeric elements 44 in this example are in the form of elongated elastomeric rods, and are shown in an incompressed state in FIGS. 1 and 2. FIGS. 3-6 show the elastomeric elements 44 in a compressed condition. The elastomeric elements 44 may be made of any suitable material, and in one example may be made of silicone. In selecting the material for the elastomeric elements 44, various considerations may be employed, such as, for example, the mechanical properties of the material, the temperature range characteristics of the material, and the electric loss and/or dielectric properties of the material. The embodiment of FIGS. 1-6 uses two parallel elastomeric elements 44, each formed as elongated tubes, but other cross-sectional shapes or number of elements may be used, including a single elastomeric element 44.

As will be described in further detail below, the elastomeric elements 44 in some embodiments may provide a benefit of being compressed between the cover 36 and the filter 10 in such a way as to resiliently position the filter 10 against the lower surface 32 of the channel. Although two parallel elastomeric elements 44 are shown, with each elastomeric element spanning essentially the entire length of the housing 24, a single elastomeric element 44, or a larger number of elastomeric elements, may be employed and may run for a shorter portion of the housing.

Figure 2:
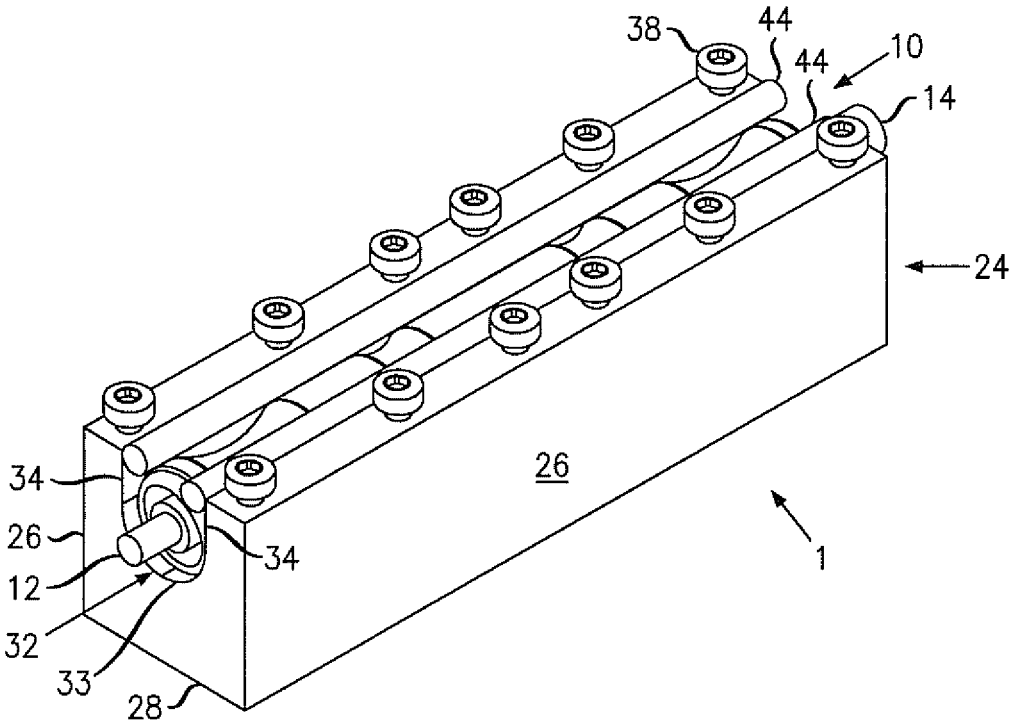
FIG. 2 is a partially assembled perspective view of the arrangement of FIG. 1 with a cover removed.
Figure 3:
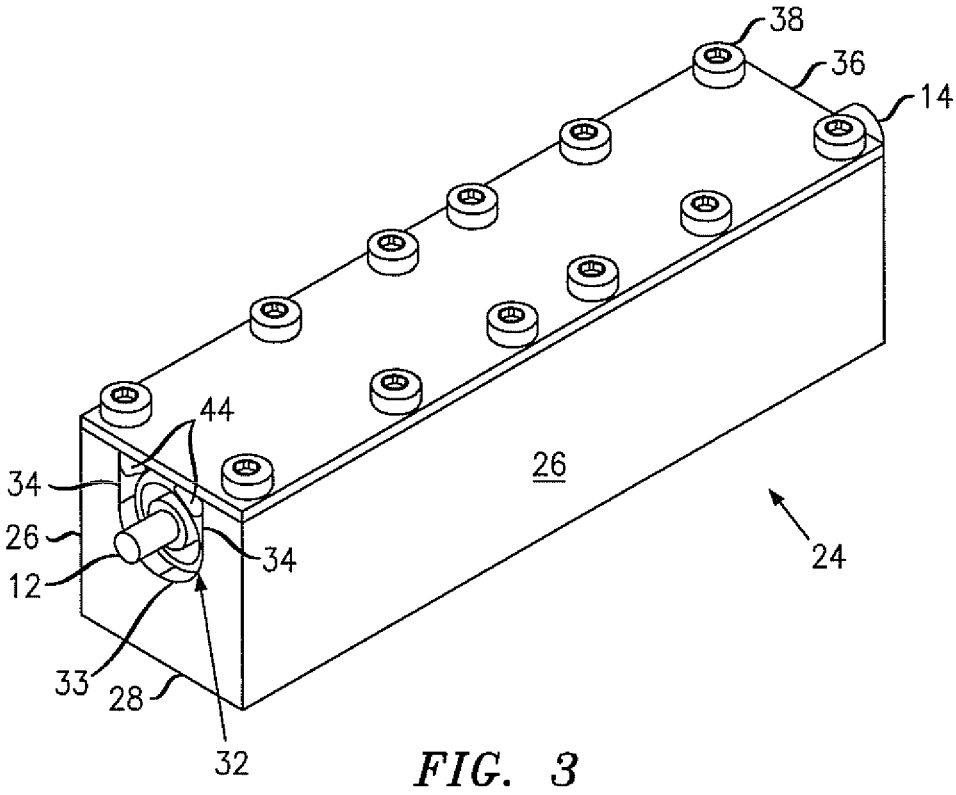
FIG. 3 is a view corresponding to FIG. 2 with a cover in place.
Figure 4:
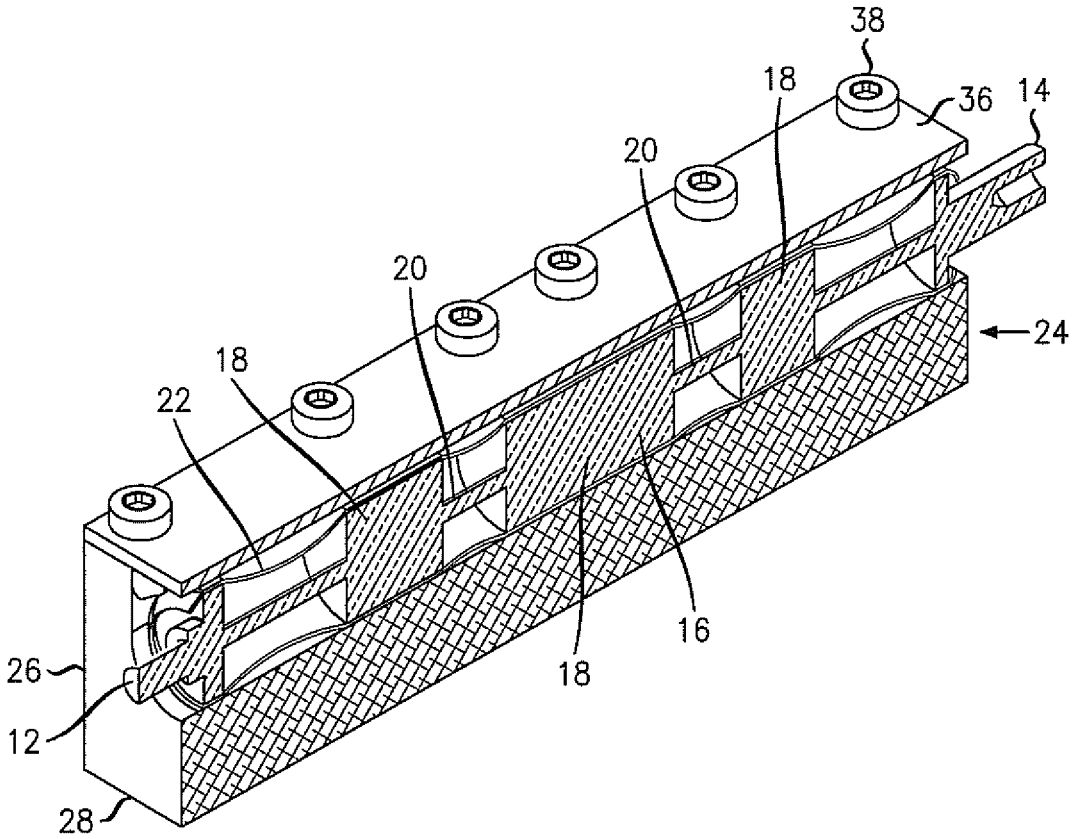
FIG. 4 is a cross-sectional perspective view of the arrangement of FIG. 1.
Figure 5:
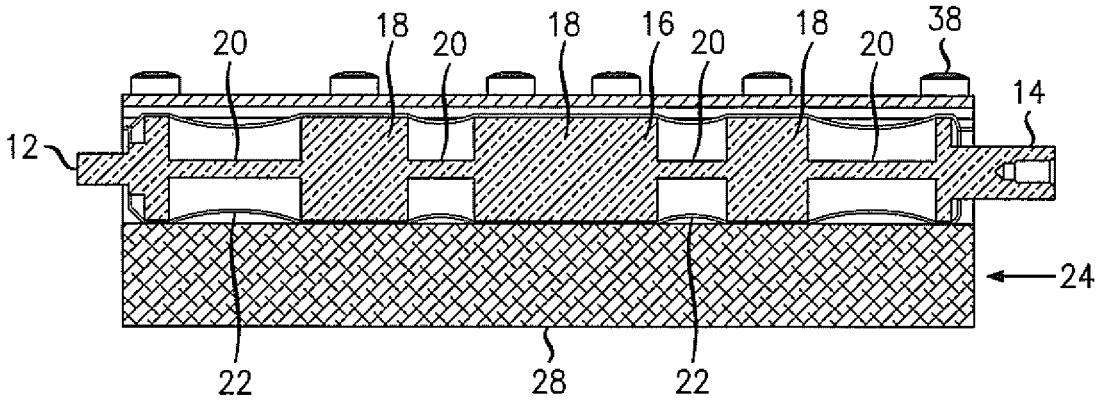
FIG. 5 is a cross-sectional side view of the arrangement of FIG. 1.
Figure 6:
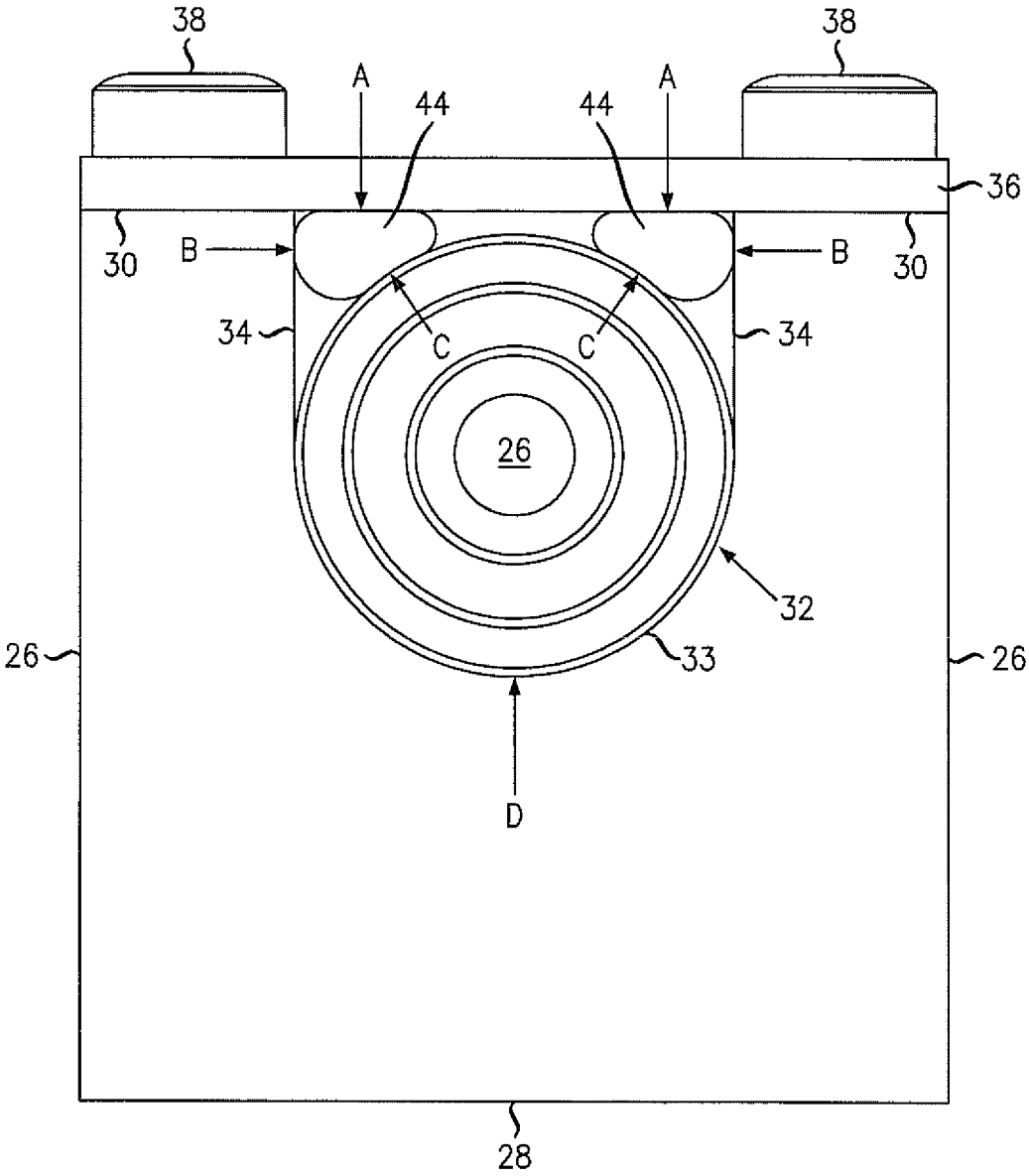
FIG. 6 is an end view of the arrangement of FIG. 1.

In FIG. 2, the elastomeric elements 44 have been laid into position above the filter 10. FIG. 3 depicts the configuration after the cover 36 has been installed and tightened and the fasteners 38 have been tightened. FIGS. 4-6 show further details of the installed configuration. In particular, FIG. 6 depicts that the elastomeric elements 44 have been deformed by installation of the cover 36. Arrows A, B and C show reaction forces on the elastomeric elements. In this case, the reaction forces are applied at an area A by the cover 36, at an area B by the side 34 of the channel, and at an area C by the filter 10. The filter 10 transfers this load to a reaction force D applied onto the housing 26 generally along the entire lower region 33 of the channel 32. These reaction forces can in some instances provide certain benefits. For example, the forces will tend to create a desirable quality of contact between the filter 10 and the housing 24. Further, if the filter 10 and the housing 24 are subjected to different degrees of thermal expansion, the filter 10 and the housing 24 can move longitudinally and radially relative to each other while still maintaining a relatively close contact. This may be desirable because in some instances it may reduce or eliminate the need to weld or otherwise affix the filter 10 to the housing 24; or in some instances may facilitate the attachment of the filter 10 to the housing 24 at a single location, while permitting for longitudinal and radial expansion and yet restraining the filter 10 in the channel.

Figure 7:
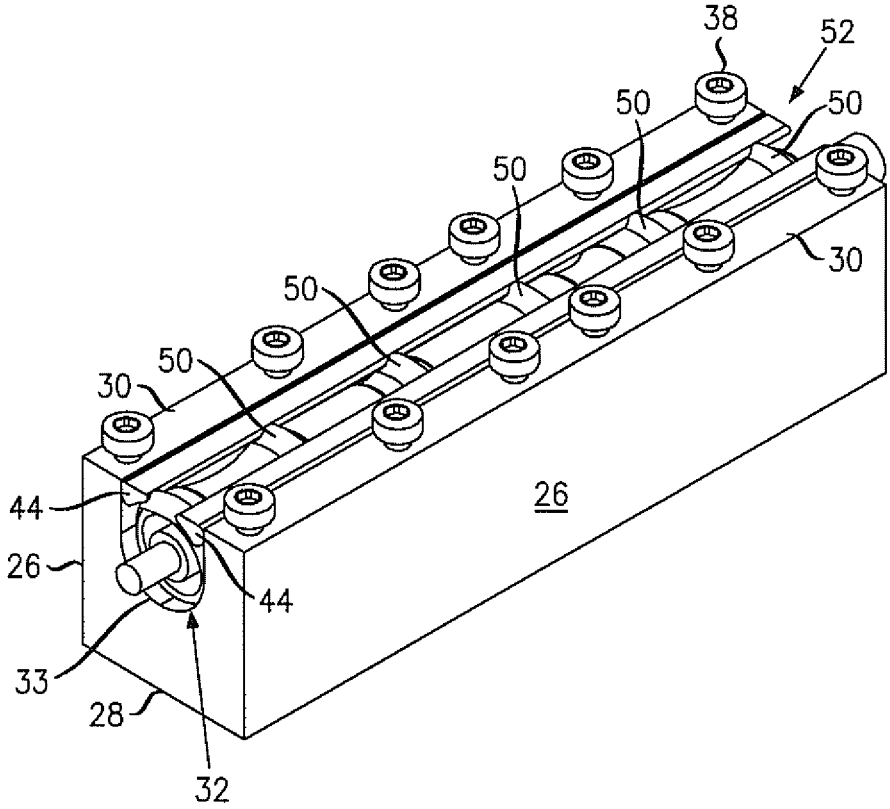
FIG. 7 is a partially assembled perspective view similar to FIG. 2, showing an alternative embodiment.

FIG. 7 shows an alternative embodiment. In FIG. 7 the components are similar to that of FIG. 1 except that the elastomeric rods 44 are connected in a ladder type configuration by elastomeric cross bars 50 form of a single elastomeric component 52. In this embodiment, the elastomeric component feature is provided by a single elastomeric component 32 having a ladder configuration that includes as a unitary structure parallel rods 44 and cross bars 50. The provision of a relatively wide single piece elastomeric element 52 in some instances may provide for greater ease of installation and/or manufacture. FIG. 7 shows the cover 36 removed for clarity, but illustrates the elastomeric element 52 in a compressed state.

Figure 8:
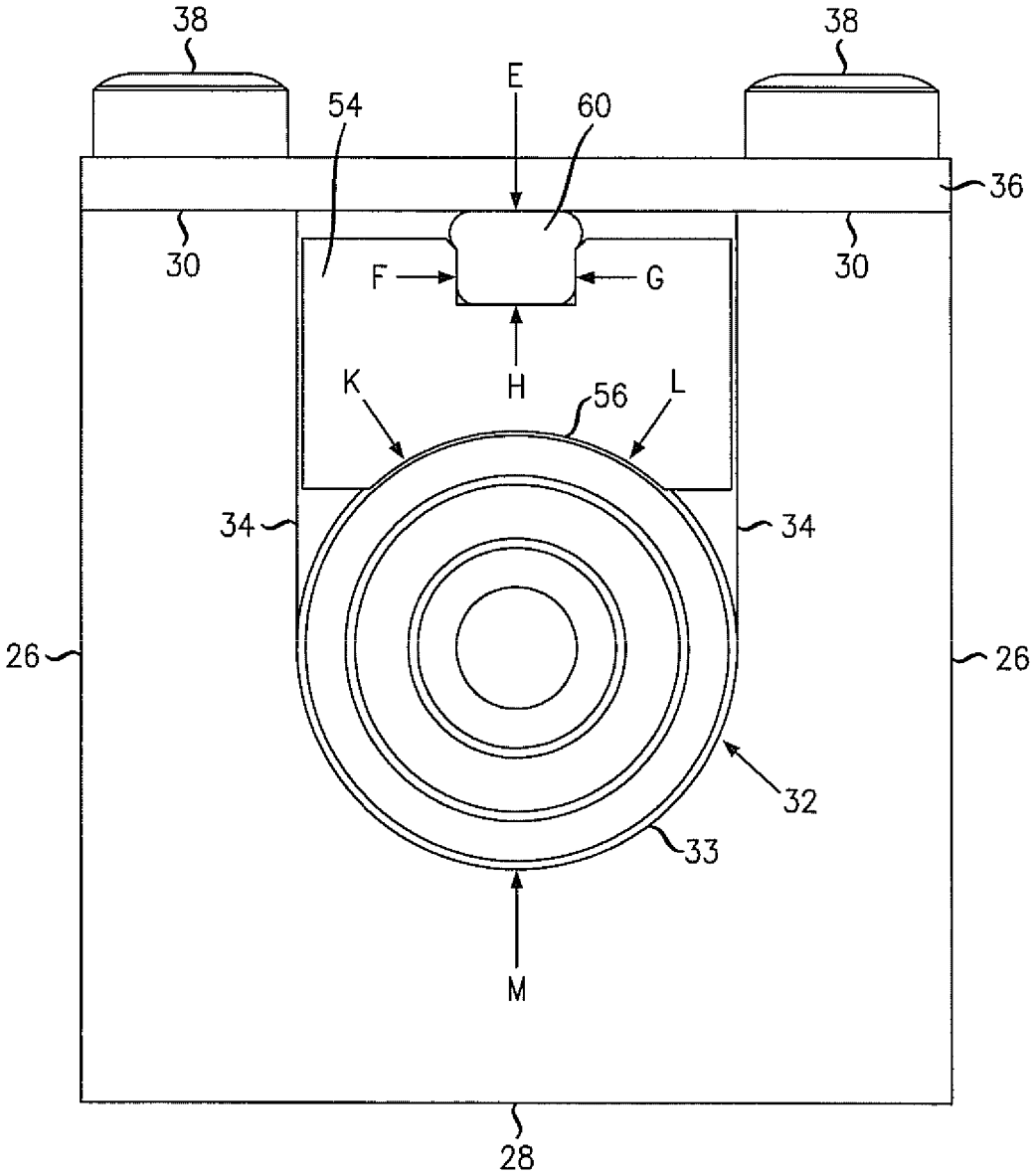
FIG. 8 is an end view similar to FIG. 6, showing another alternative embodiment.

FIG. 8 shows another alternative embodiment. In the embodiment of FIG. 8, a dielectric extension block 54 is provided. The dielectric extension block 54 includes a lower curved surface 56 that compresses against the filter 10. In the illustrated embodiment, the lower surface 56 has a concave circular curved profile portion to extend around approximately 120° of the top surface of the circumference of the filter 10. Alternatively, the extension block 54 may have a flat lower surface that contacts the filter 10 at a tangential point, or have a concave curved surface portion that may extend around greater than 120° of the top surface of the filter 10. The extension block 54 also has a top groove 58 which is sized generally to receive one or more elastomeric elements 60. The elastomeric element 60 in this example is shown in FIG. 8 in a compressed configuration having reaction force E pressing on the cover 36 and reaction forces F, G and H pressing on the extension block 54. The extension block 54 thus provides these reaction forces as forces K and L onto the filter 10 thus seating the filter 10 against the lower channel portion 33 via reaction force M, the reaction force M being similar to reaction force E in FIG. 6. A benefit of the embodiment of FIG. 8 may be that only a single elastomeric component 60 is needed. Further, in the case of the housing 24 having relatively deep vertical side walls 34, the extension block 54 can occupy this vertical space without the need for a large piece of elastomeric material. In an example, the material at the elastomeric component 60 in FIG. 8 may be silicone, and the extension block 54 may be made of polypropylene. The elastomeric component 60 in this example has a circular cylindrical shape when uncompressed, but other cross-sectional shapes may be used, as with the other embodiments.

The reaction forces described above are by way of examples in some embodiments only. The materials and geometries are also examples and can be selected to provide a desirable degree of compression force. In some instances, it may be desirable to select the compression force so that it is low enough so that the cover 36 is not unduly deflected upwards away from the housing 24. In some instances, it may be desirable to avoid undue upward deflection of the cover 36 so that the lower surface of the cover 36 remains flush or flat against the upper surface 30 of the housing 24, thus providing a desired degree of electrical contact between the cover 36 and the housing 24.

Due to the compressive forces, the filter 10 is stabilized with respect to the housing 24, and in some cases will thus tend to remain in place to a desired degree when subjected to vibrations or thermal dimensional changes of the filter 10 and/or housing 24 with respect to each other.

In the illustrated embodiments, the elastomeric members 44 have a cylindrical tube shape with a circular outer profile. However, the outer profile of the elastomeric members may be any other shape including, for example, triangular, square, hexagonal or other shapes which may have uneven outer surfaces.

In the illustrated embodiments, the elastomeric members 44 are shown as being a separate component from the filter. However, in some other embodiments the elastomeric components may be permanently or semi-permanently attached to the outside of the filter, for example, by being adhesively attached on pre-manufactured onto the filter. For example, elastomeric components may be pre-molded onto an outer surface of the filter along with or after the application of the dielectric layer.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only and do not in any way limit the invention, which is defined only by the claims.

What is claimed is:

1. A radio frequency (RF) filter assembly, comprising:
a filter component;
a housing having a groove to receive the filter component;
a cover mounted to the housing to cover the groove; and
an elastomeric member disposed between the cover and the filter component, wherein the elastomeric member includes two elastomeric sub-members and wherein the elastomeric member has the shape of a rod.

2. The assembly according to claim 1, wherein the cover has the shape of a flat plate, and wherein each elastomeric member is in contact with an outer surface of the filter component, an inner surface of the groove, and an inner surface of the cover.

3. The assembly according to claim 1, wherein the elastomeric member is made of a material comprising silicone.

4. The assembly according to claim 1, wherein the groove defines a semi-circular u-shaped surface, and wherein the filter component has a circular outer surface that rests in the semi-circular u-shaped surface.

5. The assembly according to claim 4, wherein the groove further defines two side wall surfaces, each side wall surface being on one side of the semi-circular u-shaped surface.

6. The assembly according to claim 1, wherein the two elastomeric members are parallel to each other.

7. The assembly according to claim 1, wherein the two elastomeric members are connected to each other by a plurality of cross bar portions.

8. The assembly according to claim 7, wherein the two elastomeric members and the plurality of cross bar portions have a ladder configuration.

9. The assembly according to claim 1, further comprising an extension block disposed in between the elastomeric member and the filter component.

10. The assembly according to claim 9, wherein the extension block has a lower surface having a concave curved portion.

11. The assembly according to claim 9, wherein the extension block is made of polypropylene.

12. The assembly according to claim 9, wherein the groove defines a semi-circular u-shaped surface and two side wall surfaces, each side wall surface being on one side of the u-shaped surface, and wherein the filter component has a circular outer surface that rests in the semi-circular u-shaped surface, and wherein the extension block has two side surfaces that are adjacent to the two side wall surfaces of the groove.

13. A radio frequency (RF) filter assembly, comprising:
a filter component;
a housing having a groove to receive the filter component;
a cover mounted to the housing to cover the groove;
an elastomeric member disposed between the cover and the filter component; and
an extension block disposed between the elastomeric member and the filter component, wherein the elastomeric member has the shape of a rod.

14. A radio frequency (RF) filter assembly, comprising:
a filter component;
a housing having a groove to receive the filter component;
a cover mounted to the housing to cover the groove; and
an elastomeric member disposed between the cover and the filter component, wherein the elastomeric member is in contact with an inner surface of the groove, and wherein the elastomeric member has the shape of a rod.

15. A method of stabilizing a radio frequency (RF) filter assembly, comprising:
providing a filter component, a housing having a groove to receive the filter component, and a cover mounted to the housing to cover the groove; and
compressing an elastomeric member disposed between the cover and the filter component, wherein an extension block is disposed between the elastomeric member and the filter component and the elastomeric member has the shape of a rod.

16. A method of stabilizing a radio frequency (RF) filter assembly, comprising:
providing a filter component, a housing having a groove to receive the filter component, and a cover mounted to the housing to cover the groove; and
compressing an elastomeric member disposed between the cover and the filter component, wherein the elastomeric member includes two elastomeric members, and wherein the two elastomeric members have the shape of a rod.

17. The method according to claim 16, wherein the elastomeric member is made of a material comprising silicone.

18. The method according to claim 16, wherein the groove defines a semi-circular u-shaped surface, and wherein the filter component has a circular outer surface that rests in the semi-circular u-shaped surface.

* * * * *